US006776366B2

(12) United States Patent
Tschesche

(10) Patent No.: US 6,776,366 B2
(45) Date of Patent: Aug. 17, 2004

(54) DRIVE ASSEMBLY FOR DUAL COACTING ROLLERS

(76) Inventor: Martin Tschesche, 2511 Rolac Rd., Jacksonville, FL (US) 32207

( * ) Notice: Subject to any disclaimer, the term of this patent is extended or adjusted under 35 U.S.C. 154(b) by 168 days.

(21) Appl. No.: 10/262,712

(22) Filed: Oct. 2, 2002

(65) Prior Publication Data

US 2004/0065132 A1 Apr. 8, 2004

(51) Int. Cl.[7] ..... B02B 5/02; B02C 1/10

(52) U.S. Cl. ..... 241/101.2; 241/230; 241/234; 100/168; 100/172

(58) Field of Search ..... 493/416, 471, 493/475; 100/168, 169, 172; 241/101.2, 227, 230, 234; 72/248, 249

(56) References Cited

U.S. PATENT DOCUMENTS

| | | | | |
|---|---|---|---|---|
| 2,144,841 A | | 1/1939 | Glaser | |
| 2,481,201 A | | 9/1949 | Collier | |
| 3,208,677 A | | 9/1965 | Hesse | |
| 3,664,522 A | | 5/1972 | Goto | |
| 3,754,754 A | | 8/1973 | Peterson | |
| 3,792,948 A | | 2/1974 | Martinez | |
| 3,889,939 A | * | 6/1975 | Faltin | 270/21.1 |
| 4,377,260 A | * | 3/1983 | Huffman | 241/101.2 |
| 4,545,541 A | | 10/1985 | Jensen | |
| 4,621,966 A | | 11/1986 | Luperti et al. | |
| 4,715,596 A | | 12/1987 | Cantrell et al. | |
| 5,154,364 A | * | 10/1992 | Ketting | 241/37 |
| 5,566,902 A | | 10/1996 | Thom, Jr. | |
| 5,697,292 A | | 12/1997 | Simmons | |
| 5,697,880 A | | 12/1997 | Auerbach | |
| 5,769,408 A | * | 6/1998 | Selak et al. | 271/10.03 |
| 6,135,439 A | | 10/2000 | Ikeda | |
| 6,203,005 B1 | | 3/2001 | Bednarek et al. | |
| 6,247,691 B1 | | 6/2001 | Drago et al. | |

* cited by examiner

*Primary Examiner*—Ed Tolan
(74) *Attorney, Agent, or Firm*—Thomas C. Saitta

(57) ABSTRACT

A drive assembly for a dual coacting roller machine having a driven sprocket mounted onto a first roller shaft, a drive sprocket mounted onto a second roller shaft, and a pair of idler sprockets connected by a belt to the driven sprocket and drive sprocket, wherein one of the idler sprockets is mounted onto a mounting bracket connected to the driven sprocket, such that repositioning of the driven sprocket relative to the drive sprocket produces a corresponding repositioning of the mounting bracket and idler sprocket, such that the tension on the belt remains essentially the same.

18 Claims, 4 Drawing Sheets

DRIVE ASSEMBLY FOR DUAL COACTING ROLLERS

BACKGROUND OF THE INVENTION

The invention relates generally to the field of drive assemblies for dual coacting rollers, such as found in roll forming machines, sheet feeding machines, roll milling machines or the like, where the machinery includes a pair of parallel rollers mounted onto roller shafts contained in a frame or support, with the rollers being rotated in opposite directions such that sheet material or other objects are pulled between and passed through the rollers. More particularly, the invention relates to such drive assemblies for dual coacting rollers in which the separation distance or gap between the two rollers is adjustable.

There are various types of drive assemblies for dual coacting rollers, wherein the rotational power is transferred to the rollers by single or multiple chains, gearing, belts or the like. A typical machine utilizes a complicated gear box, sprockets or toothed gears mounted onto to the central shafts of the rollers, with chains or timing belts running from a motor to the sprockets or gears. Examples of these types of machines can be seen in U.S. Pat. No. 2,481,201 to Collier, U.S. Pat. No. 2,144,841 to Glaser, U.S. Pat. No. 3,208,677 to Hesse, U.S. Pat. No. 4,545,541 to Jensen, U.S. Pat. No. 4,621,966 to Luperti et al., U.S. Pat. No. 5,566,902 to Thom, Jr., U.S. Pat. No. 5,697,292 to Simmons, U.S. Pat. No. 5,697,880 to Auerbach, and U.S. Pat. No. 6,247,691 to Drago et al.

It is often necessary or at least desirable to adjust the separation distance or gap between the rollers, or to change the diameter of one of the rollers in order to adjust the reduction ratio. In the known systems such an adjustment or change is excessively complicated due to the need to readjust the tension on the chain or belt after the gap between the rollers has been widened or narrowed, or after one of the rollers has been switched for a roller of different size. This is especially true in machines that use a gear box.

It is an object of this invention to provide a drive assembly for dual coacting roller machines wherein the rollers are rotated in opposite directions such that sheet material or other objects are pulled between and passed through the rollers, wherein the separation-distance or gap between the two rollers is adjustable, and wherein the rotational power is transferred to the rollers through a combination of sprockets or toothed gears and timing belts or chains, such that the gap between the rollers can be easily adjusted without the need for a complicated re-tensioning of the drive belt or chain. It is a further object to provide such a drive assembly wherein the tension of the timing belt or chain is automatically and directly accomplished upon the repositioning of the roller. It is a further object to provide such a drive assembly wherein the motor or other power means for rotating the shafts can be disposed to either side of the roller pair. It is a further object to provide such a drive assembly where the rotational speed can be easily changed by substitution of sprockets or gears of differing diameters. These objects expressly set forth are supported in the following disclosure, and other objects not expressly set forth above will be apparent as well upon review of the following disclosure.

SUMMARY OF THE INVENTION

The invention is in general an improved drive assembly for dual coacting rollers, such as found in roll forming machines, sheet feeding machines, roll milling machines or the like, where the machinery includes a pair of parallel rollers mounted onto roller shafts contained in a frame or support, with the rollers being rotated in opposite directions such that sheet material or other objects are pulled between and passed through the rollers. The invention is particularly suited for such machinery where it is desirable or necessary to adjust the separation distance or gap between the two rollers, or to allow for a change of one roller to increase or decrease the roller diameter in order to adjust the reduction ratio. The drive assembly comprises four sprockets, pulleys or gears interconnected in serpentine fashion by a double-sided, toothed belt, often known as a twin timing or power belt, or by a chain or similar means. The sprockets comprise in combination a driven sprocket mounted on or connected to a first roller shaft, shown herein for illustrative purposes as the upper or outer roller shaft, the term outer typically signifying the roller disposed outermost from a table, floor or plate member of the machine, a drive sprocket mounted on or connected to a second roller shaft, shown herein as the lower or inner roller shaft, a paired idler sprocket in fixed spatial relation to the driven sprocket, shown herein as positioned toward the forward or ejection side of the assembly, and a tensioner idler sprocket, shown herein as positioned toward the rear or receiving side of the assembly, although such positions could be reversed. In one embodiment the paired idler sprocket and the tensioner idler sprocket are positioned generally adjacent, below or extended in the drive sprocket direction of the drive assembly, and in another embodiment of the invention are positioned generally adjacent, above or extended in the driven sprocket direction of the drive assembly. The drive sprocket is rotated by power means, such as for example an electric or hydraulic motor, such that rotation of the drive sprocket results in rotation of the remaining sprockets due to movement of the serpentine belt, and thus rotation of the shafts and rollers themselves.

The tensioner idler sprocket is preferably mounted on a fixed mounting bracket that is connected to the roller frame and retains the drive sprocket, with the tensioner idler sprocket being adjustable relative to the drive sprocket. As shown in a preferred embodiment herein, the tensioner idler sprocket is mounted within a generally vertical or slightly angled slot disposed on the lower portion of the fixed mounting bracket such that the vertical position of the tensioner idler sprocket can be altered relative to the drive sprocket. The fixed mounting bracket allows for movement of the tensioner idler sprocket for adjustment of the tension on the double-sided toothed belt or chain as needed. In an alternative embodiment, the tensioner idler sprocket is mounted onto an adjustable mounting bracket in combination with the driven sprocket, wherein the adjustable mounting bracket is movable relative to the roller frame or support and relative to the first roller and drive sprocket.

The driven sprocket and the paired idler sprocket are preferably mounted on an adjustable mounting bracket, preferably generally L-shaped as shown herein, with the driven sprocket and the paired idler sprocket being in fixed spatial relation to each other. The adjustable mounting bracket is movable relative to the roller frame or support and relative to the second roller and drive sprocket, such that the size of the gap between the two rollers can be adjusted by raising or lowering the first roller relative to the roller frame and the second roller. Such action results in the corresponding raising or lowering of the adjustable mounting bracket such that the spatial relationship of the driven sprocket and the paired idler sprocket remains unchanged, and therefore the proper rotation speed of the first roller is maintained. In similar manner, should it be desired to change the diameter of one or both rollers, the adjustable mounting bracket will insure that the proper relationship between the driven sprocket and the paired idler sprocket, and the proper rotation speed of the two rollers, is not changed. In an alternative embodiment, the paired idler sprocket is mounted onto a fixed mounting bracket in combination with the drive sprocket.

In alternative terms, the invention is a dual coacting roller machine, said roller machine having a first roller shaft and first roller and a second roller shaft and second roller mounted in parallel to define a gap between said first roller and said second roller, wherein said gap may be increased or decreased by repositioning said first roller shaft and said first roller relative to said second roller shaft and said second roller, said roller machine further comprising a drive assembly comprising:

a drive sprocket connected to said second roller shaft, such that rotation of said drive sprocket rotates said second roller shaft and said second roller;

power means for rotation of said drive sprocket;

a driven sprocket connected to said first roller shaft, such that rotation of said driven sprocket rotates said first roller shaft and said first roller;

a pair of idler sprockets;

a fixed mounting bracket connecting said drive sprocket to one of said pair of idler sprockets, and an adjustable mounting bracket connecting said driven sprocket to the other of said pair of idler sprockets in a fixed spatial relationship, such that repositioning of said driven sprocket results in corresponding repositioning of said other of said pair of idler sprockets;

a belt connecting said drive sprocket, said driven sprocket and said pair of idler sprockets, such that rotation of said drive sprocket results in rotation of said driven sprocket and said pair of idler sprockets;

whereby repositioning said first roller shaft relative to said second roller shaft results in corresponding movement of said adjustable mounting bracket relative to said fixed mounting bracket.

Additionally, the invention is a drive assembly for a dual coacting roller machine, said roller machine having a first roller shaft and a first roller and a second roller shaft and second roller mounted in parallel to define a gap between said first roller and said second roller, wherein said gap may be increased or decreased by repositioning said first roller shaft and said first roller relative to said second roller shaft and said second roller, and wherein said first roller shaft and said first roller relative rotate in a direction opposite to said second roller shaft and said second roller, said drive assembly comprising:

a drive sprocket connected to said second roller shaft;

a driven sprocket connected to said first roller shaft;

a pair of idler sprockets;

a belt connecting said drive sprocket, said driven sprocket and said pair of idler sprockets, such that rotation of said drive sprocket results in rotation of said driven sprocket and said pair of idler sprockets; and a mounting bracket connecting said driven sprocket to one of said pair of idler sprockets in a fixed spatial relationship, such that repositioning of said driven sprocket relative to said drive sprocket results in corresponding repositioning of said one of said pair of idler sprockets.

Additionally, the invention is a dual coacting roller machine, said roller machine having a first roller shaft and a first roller and a second roller shaft and second roller mounted in parallel to define a gap between said first roller and said second roller, wherein said gap may be increased or decreased by repositioning said first roller shaft and said first roller relative to said second roller shaft and said second roller, and wherein said first roller shaft and said first roller relative rotate in a direction opposite to said second roller shaft and said second roller, and further comprising a drive assembly comprising:

a drive sprocket connected to said second roller shaft;

a driven sprocket connected to said first roller shaft;

a pair of idler sprockets;

a belt connecting said drive sprocket, said driven sprocket and said pair of idler sprockets, such that rotation of said drive sprocket results in rotation of said driven sprocket and said pair of idler sprockets;

power means to rotate said drive sprocket; and a mounting bracket connecting said driven sprocket to one of said pair of idler sprockets in a fixed spatial relationship, such that repositioning of said driven sprocket relative to said drive sprocket results in corresponding repositioning of said one of said pair of idler sprockets.

DETAILED DESCRIPTION OF THE INVENTION

Figure 1:
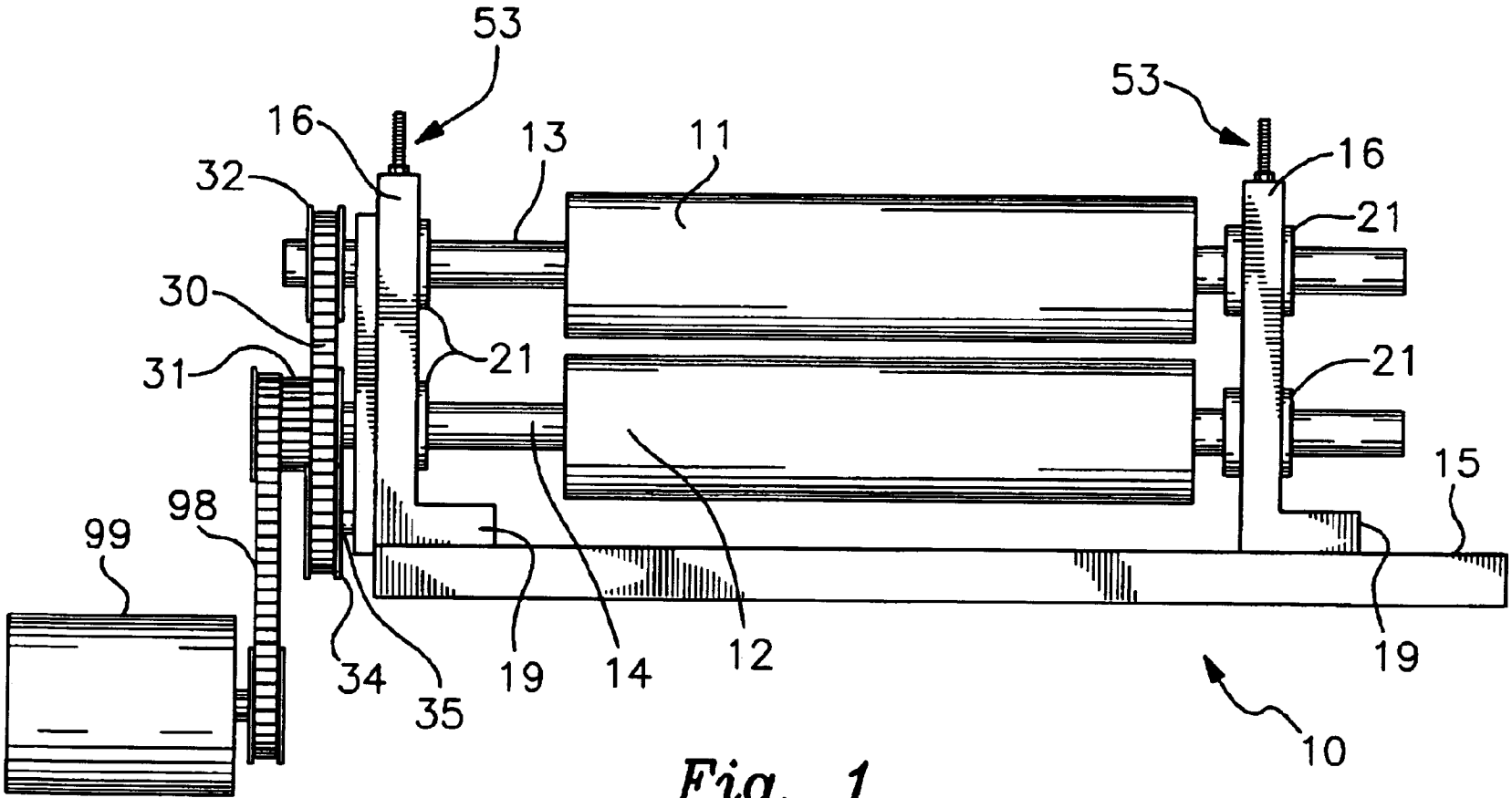
FIG. 1 is a side view of the improved drive assembly of the invention as mounted onto a representative machine having dual coacting rollers.

With reference to the drawings, the invention will now be described in detail with regard for the best mode and the preferred embodiment. References herein to terms of direction such as vertical, horizontal, upper, lower or the like shall be understood as corresponding to the directions as oriented in the drawings, i.e., taken as one roller being disposed generally vertically over a second roller with a generally horizontal table or support surface, as likewise references to forward or rearward shall be taken to refer to the ejection side and the receiving side of the rollers respectively, but it is contemplated that such directions are not absolute and the orientation of the invention may be altered without departing from the teachings herein.

In a most general sense, the invention is an improved drive assembly for dual coacting roller machines or equipment, where the machine may comprise many commonly known types of equipment which incorporate a pair of parallel-mounted, powered rollers which are rotated in opposite directions such that material is drawn into and passed between the rollers, whether for processing in some manner by the rollers themselves or as material handling equipment to move the material. Examples of such machines include roll forming machines, sheet feeding machines, roll milling machines or the like. In particular, the invention is applicable to such machines where it is necessary or desirable to be able to easily and quickly adjust or alter the gap between the two rollers.

Figure 2:
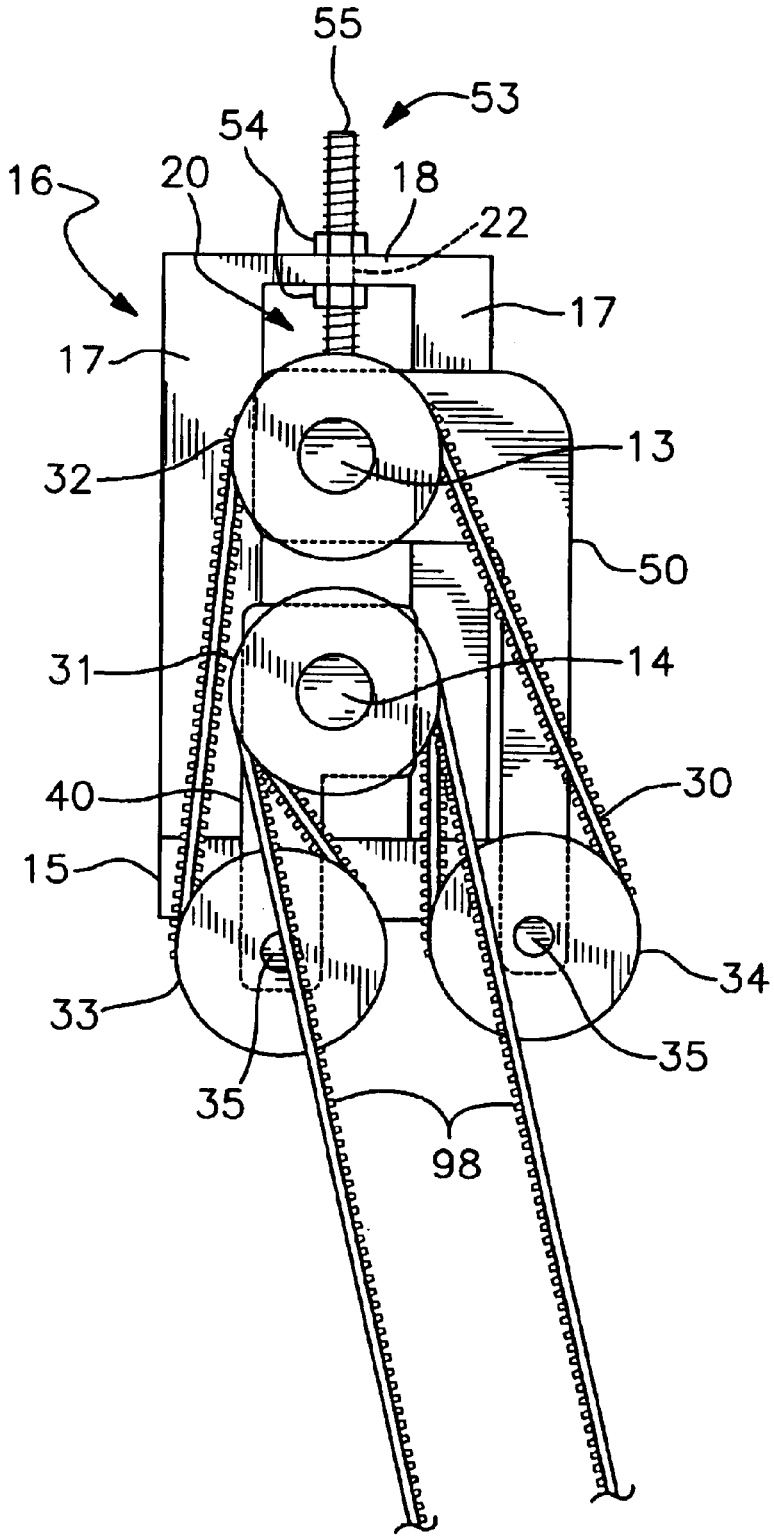
FIG. 2 is an end view of the improved drive assembly.

A representative dual coacting roller machine 10 is illustrated in FIG. 1. The roller machine 10 comprises a first, outer or upper roller 11 mounted onto a first, outer or upper roller shaft 13, and a parallel second, inner or lower roller 12 mounted onto a second, inner or lower roller shaft 14. The roller shafts 13 and 14 are powered or driven by power means 99, such as an electric or hydraulic pump. The roller shafts 13 and 14 are disposed within bearing assemblies 21, preferably of a sealed type such as double row ball bearings, roller bearings, needle bearings or the like. The roller shafts 13 and 14 are mounted to support stands or frames 16, which as shown comprise vertical stand members 17 topped by a cross brace member 18 to define an open interior 20, as best seen in FIG. 2, and having mounting flanges or feet members 19 which are connected in secure manner to a horizontal base member 15 by mechanical fasteners, welding or like mechanisms. In an alternative embodiment known in the art, the second roller shaft 14 and the base 15 may be extended beyond the drive sprocket 31, with a third support stand 16 with a bearing assembly 21, not shown, provided to provide greater support for the drive sprocket 31 and the second roller shaft 14.

The drive assembly comprises four toothed or ridged sprockets, gears, pulleys 31, 32, 33 and 34 or similar devices (hereinafter referred to by the inclusive term sprockets) adapted to interact with a serpentine belt, chain 30 or similar member (hereinafter referred to by the inclusive term belt) such that the sprockets 31, 32, 33 and 34 are rotated in tandem by movement of the belt 30, the rotational force being provided by a power means 99, such as an electric or hydraulic motor, preferably utilizing a toothed power belt or chain 98 connected to the drive sprocket 31. A double-sided, toothed belt 30, commonly referred to as a timing belt, is preferred such that there is direct transfer of power from the belt 30 to the sprockets 31, 32, 33 and 34 with no slippage. One sprocket is a drive sprocket 31, which is mounted on or connected to the second roller shaft 14 such that rotation of the drive sprocket 31 causes equal rotation of the second roller shaft 14. As shown, the drive sprocket 31 may be of sufficient width longitudinally such that both the serpentine belt 30 and the power belt 98 from the power means 99 can be disposed thereon, or alternatively a pair of drive sprockets 31 may be mounted onto the second roller shaft 14 such that the power belt 98 is connected to one such drive sprocket 31 and the serpentine belt 30 is connected to the other drive sprocket 31.

A driven sprocket 32 is mounted on or connected to the first roller shaft 13. The driven sprocket 32 is rotated by the serpentine belt 30. Where it is desired that the first and second rollers 11 and 12 rotate at the same speed, the driven sprocket 32 and the drive sprocket 31 are of the same operational diameter. For faster rotation of first roller 11 relative to second roller 12, the driven sprocket 32 will be smaller in operational diameter than the drive sprocket 31. For slower rotation of first roller 11 relative to second roller 12, the driven sprocket 32 will be larger in operational diameter than the drive sprocket 31.

Figure 6:
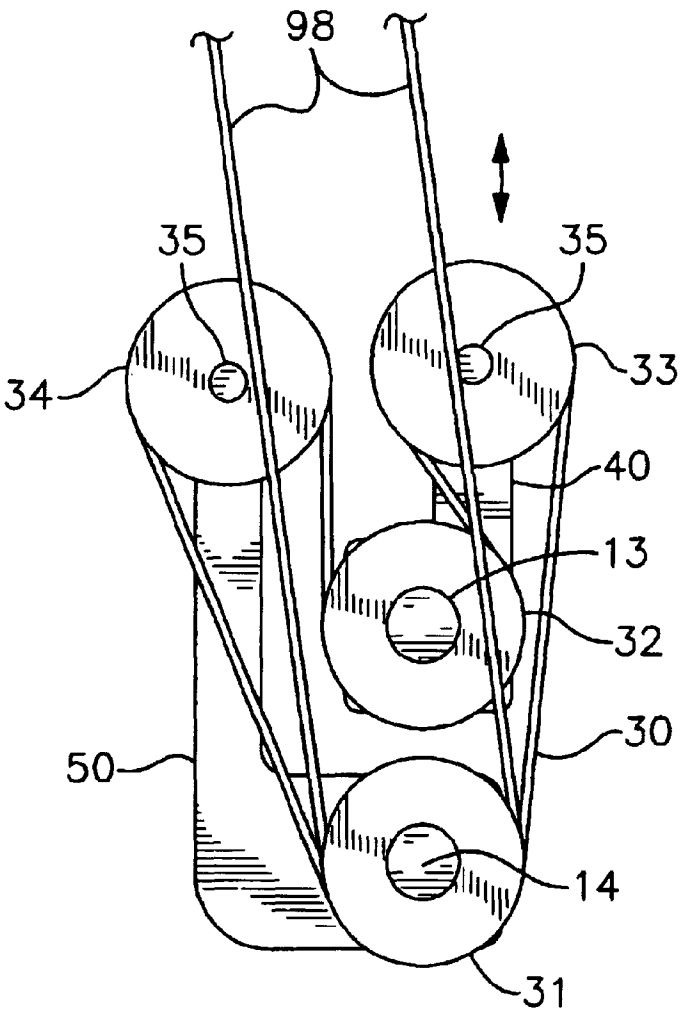
FIG. 6 is a diagram showing the relation of the sprockets and the mounting brackets in an alternative embodiment wherein the paired and tensioner idler sprockets are positioned adjacent the driven sprocket.

Two idler sprockets 33 and 34 are interconnected by belt 30 to drive sprocket 31 and driven sprocket 32, with the idler sprockets 33 and 34 mounted so as to be freely rotatable. In a first embodiment as shown in FIG. 2, the tensioner idler sprocket 33 is adapted to be spatially adjustable relative to the drive sprocket 31 and the first mounting bracket 40, and is provided as a secondary or auxiliary means for tightening or tensioning the belt 30 when necessary by simple adjustment. The paired idler sprocket 34 is disposed in fixed spatial relation to the driven sprocket 32 on a second mounting bracket 50 in a manner whereby repositioning of the driven sprocket 32 relative to the drive sprocket 31 and the support stands 16 results in a repositioning of the paired idler sprocket 34 as well. In a second embodiment as shown in FIG. 6, the tensioner idler sprocket 33 is adapted to be spatially adjustable relative to the driven sprocket 32 on first mounting bracket 40. The paired idler sprocket 34 is disposed in fixed spatial relation to the drive sprocket 31 on second mounting bracket 50. Repositioning of the driven sprocket 32 relative to the drive sprocket 31 and the support stands 16 results in a corresponding repositioning of the tensioner idler sprocket 33 as well.

The second roller shaft 14, the corresponding bearing assemblies 21 and the drive sprocket 31 are connected or mounted to the stands 16 in a fixed manner, such that adjustments altering the size of the gap between the rollers 11 and 12 are accomplished by repositioning roller 11 and first roller shaft 13. Obviously, the device may be structured such that the position of the second roller shaft 14, the corresponding bearing assemblies 21 and the drive sprocket 31 relative to the stands 16 may be altered, but it is preferred that the roller machine 10 can be adjusted as desired quickly and easily by adjustment of the position of the first roller shaft 13 alone relative to the stands 16. In a preferred embodiment, the second roller shaft 14 and drive sprocket 31, along with the tensioner idler sprocket 33, are mounted onto a first mounting bracket 40, as shown in FIG. 2, where the first mounting bracket 40 is fixed in position relative to the support stand 16. Alternatively, as shown in FIG. 6, the second roller shaft 14 and drive sprocket 31, along with paired idler sprocket 34, are mounted onto a second mounting bracket 50 that is fixed relative to the support stand 16.

The first mounting bracket 40 comprises a plate member having a roller shaft receiving bore 41 to receive either the second roller shaft 14 therethrough in one embodiment or the first roller shaft 13 in the alternative embodiment, and means 42 to receive the tensioner idler sprocket 33 in a manner such that the tensioner idler sprocket 33 is spatially adjustable in the vertical direction relative to first mounting bracket 40 and the drive sprocket 31 or the driven sprocket 32, respectively. The first mounting bracket 40 is provided with means 49 to secure the first mounting bracket 40 to the stand 16, in the embodiment of FIG. 2, shown herein as apertures to receive mechanical fasteners, or alternatively to the bearing assembly 21 connected to the first shaft 13, in the embodiment shown in FIG. 6. The receiver means 42 is preferably disposed slightly to the rear of the drive sprocket 31, i.e., toward the feed or input side of the roller machine 10. As shown, the adjustable receiver means 42 preferably comprises an elongated slot 43, generally vertical or slightly tilted in orientation, within which is disposed a tensioner idler sprocket mounting plate member 44 provided with a receiving bore 45 to receive a mounting shaft 35. The receiver means 42 further comprises an adjustment aperture which receives a threaded rod 48 joined to the mounting plate member 44, such that the position of the mounting plate member 44 and thus the position of the tensioner idler sprocket 33 can be altered relative to the first mounting bracket 40 and the drive sprocket 31 by rotation of adjustment nuts 47. In an alternative embodiment, the adjustable receiver means 42 may be connected directly to the stand 16 or base 15 without connection to the second shaft 14, provided that the proper angular relationship between the tensioner idler sprocket 33 and the drive sprocket 31 is maintained when the position of the tensioner idler sprocket 33 is changed. Adjustment of the tensioner idler sprocket 33 allows the tension of the belt 30 to be easily adjusted as required.

Figure 4:
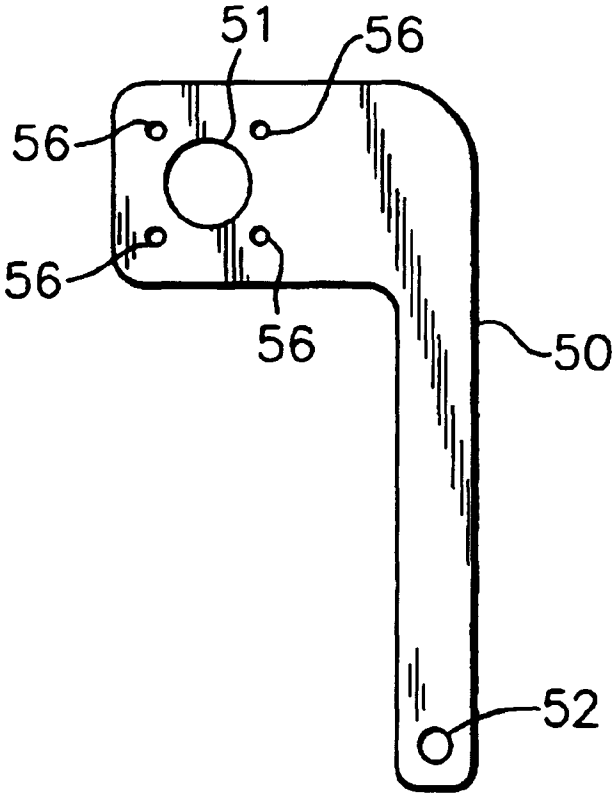
FIG. 4 is a view of the adjustable L-shaped mounting bracket for the upper driven sprocket and the forward idler sprocket.
Figure 3:
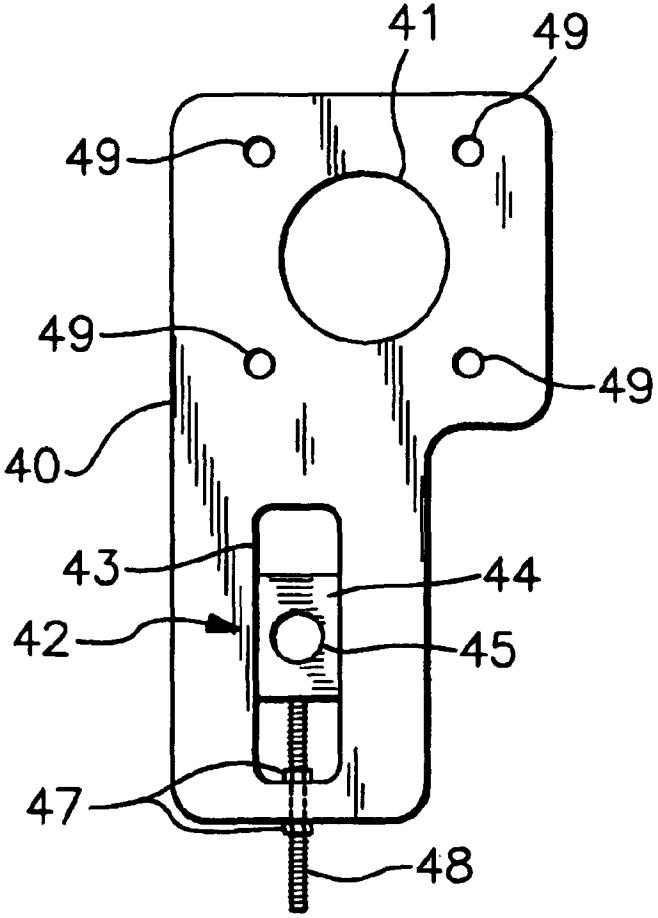
FIG. 3 is a view of the fixed slotted mounting bracket for the lower drive sprocket and the rear idler sprocket.

The paired idler sprocket 34 is mounted onto a second mounting bracket 50, shown herein in FIG. 4 as a generally L-shaped, plate member having a roller shaft receiving bore 51 to receive the first roller shaft 13 therethrough, in the embodiment of FIG. 2, or to receive the second roller shaft 14 in the embodiment of FIG. 6, and a paired idler sprocket receiving bore 52 to receive a mounting shaft 35 for rotatably mounting the paired idler sprocket 34. In the first embodiment the second mounting bracket 50 is sized such that the paired idler sprocket 34 is disposed beneath and slightly forward, i.e. to the side opposite of the tensioner idler sprocket 33, of the drive sprocket 31, while in the second embodiment the paired idler sprocket 34 is disposed above and slightly to the rear of the drive sprocket 31. The second mounting bracket 50 is adjustable relative to the support stand 16 in the embodiment of FIG. 2 and maintains the paired idler sprocket 34 and the driven sprocket 32 in fixed spatial and angular relation, such that movement of the first roller shaft 13 and driven sprocket 32 in the vertical direction results in equivalent repositioning of the paired idler sprocket 34. Means 56 to secure the adjustable second mounting bracket 50 to the bearing assemblies 21 disposed about the first roller shaft 13 and positioned within the open interior 20 of the stands 16 are provided, shown herein as apertures to receive mechanical fasteners. Preferably, the bearing assemblies 21 for the first roller shaft 13 are provided with a configuration or are connected to plates or the like which secure the bearing assemblies 21 within the open interior 20 of the stands 16 but allow for vertical movement of the first roller shaft 13 and the bearing assemblies 21 relative to the stands 16. Means 53 to vertically adjust the position of the first roller shaft 13, the driven sprocket 32, the second mounting plate 50 and the paired idler sprocket 34 are provided, and as shown preferably comprise threaded rods 55 disposed within adjustment bores 22 positioned in the cross brace members 18 and connected to the bearing assemblies 21 of the first roller shaft 13, such that rotation of the adjustment nuts 54 repositions the first roller shaft 13, the driven sprocket 32, the second mounting plate 50 and the paired idler sprocket 34 relative to the stands 16 and the driven sprocket 31.

Figure 5:
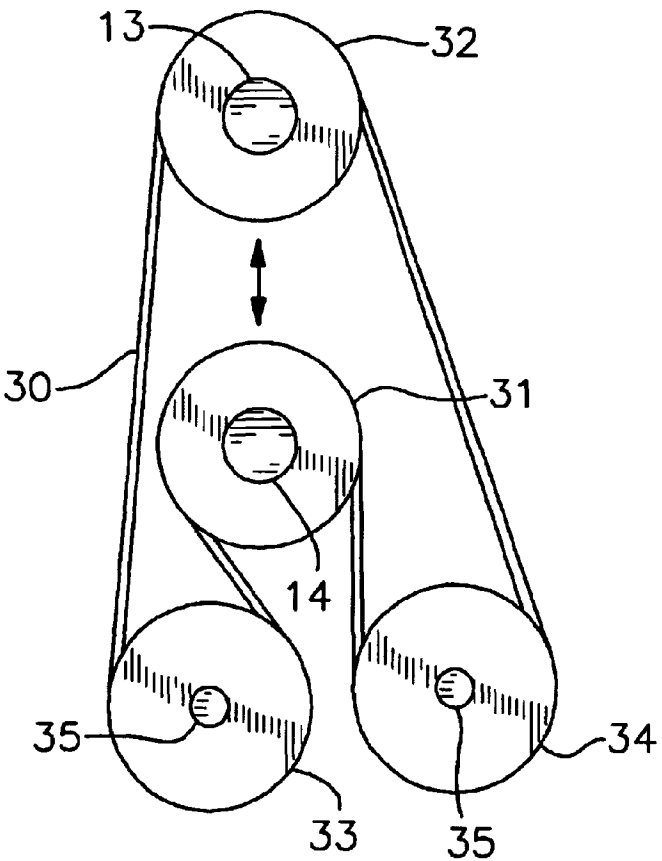
FIG. 5 is a diagram showing the relative positions of the sprockets when the L-shaped mounting bracket is raised to increase the gap between the rollers.

Since the driven sprocket 32 and the paired idler sprocket 34 are mounted in tandem on the second mounting plate 50, raising or separating the driven sprocket 32 in order to adjust the gap between the rollers 11 and 12 results in equivalent movement of the paired idler sprocket 34, as shown in FIG. 5. In this manner, the tension on the belt 30 remains virtually unchanged due to the angular and spatial relationship of the sprockets 31, 32, 33 and 34 whenever the gap between the rollers 11 and 12 or the separation of the roller shafts 13 and 14 is altered. Thus altering the relative positions of the rollers 11 and 12 is easily and quickly accomplished by simple operation of the adjustment means 53, with any slight retensioning accomplished by simple adjustment of the tension idler sprocket receiving means 42.

In the alternative embodiment of FIG. 6, the second mounting bracket 50 is fixed relative to the support stand 16 and the first mounting bracket 40 is adjustable relative to the support stand 16. In this manner the gap between the rollers 11 and 12 is adjusted by repositioning first mounting bracket 40. This embodiment is preferable in certain situations, since the power means 99 may be mounted above the rollers 11 and 12, precluding the need to provide access openings in the base member 15 of a machine 10.

Since the driven sprocket 32 and the tensioner idler sprocket 33 are mounted in tandem on the adjustable first mounting plate 40, raising or separating the driven sprocket 32 in order to adjust the gap between the rollers 11 and 12 results in equivalent movement of the tensioner idler sprocket 33. In this manner, the tension on the belt 30 remains virtually unchanged due to the angular and spatial relationship of the sprockets 31, 32, 33 and 34 whenever the gap between the rollers 11 and 12 or the separation of the roller shafts 13 and 14 is altered. Thus altering the relative positions of the rollers 11 and 12 is easily and quickly accomplished by simple operation, with any slight retensioning accomplished by simple adjustment of the tension idler sprocket receiving means 42.

It is further contemplated that multiple roller machines 10 may be aligned sequentially, with two or more of the drive sprockets 31 of such machines 10 rotated by a single power means 99 where the power belt 98 is extended and connected to the multiple drive sprockets 31.

It is contemplated that equivalents and substitutions for certain elements set forth and described above may be obvious to those skilled in the art, and therefore the true scope and definition of the invention is to be as set forth in the following claims.

I claim:

1. A dual coacting roller machine, said roller machine having a first roller shaft and first roller and a second roller shaft and second roller mounted in parallel to define a gap between said first roller and said second roller, wherein said gap may be increased or decreased by repositioning said first roller shaft and said first roller relative to said second roller shaft and said second roller, said roller machine further comprising a drive assembly comprising:

a drive sprocket connected to said second roller shaft, such that rotation of said drive sprocket rotates said second roller shaft and said second roller;

power means for rotation of said drive sprocket;

a driven sprocket connected to said first roller shaft, such that rotation of said driven sprocket rotates said first roller shaft and said first roller;

a pair of idler sprockets;

a fixed mounting bracket connecting said drive sprocket to one of said pair of idler sprockets, and an adjustable mounting bracket connecting said driven sprocket to the other of said pair of idler sprockets in a fixed spatial relationship, such that repositioning of said driven sprocket results in corresponding repositioning of said other of said pair of idler sprockets;

a belt connecting said drive sprocket, said driven sprocket and said pair of idler sprockets, such that rotation of said drive sprocket results in rotation of said driven sprocket and said pair of idler sprockets;

whereby repositioning said first roller shaft relative to said second roller shaft results in corresponding movement of said adjustable mounting bracket relative to said fixed mounting bracket.

2. The roller machine of claim 1, wherein said idler sprockets are disposed adjacent said drive sprocket.

3. The roller machine of claim 1, wherein said idler sprockets are disposed adjacent said driven sprocket.

4. The roller machine of claim 1, wherein said pair of idler sprockets consists of a paired idler sprocket and a tensioner idler sprocket, said paired idler sprocket being attached to either said fixed mounting bracket or said adjustable mounting bracket in a fixed position, and said tensioner idler sprocket being attached to the other of said fixed mounting bracket or said adjustable mounting bracket in an adjustable position, whereby said belt may be tightened by moving said tensioner idler sprocket.

5. The roller machine of claim 1, wherein said fixed mounting bracket is mounted to said roller machine in fixed manner and said adjustable mounting bracket is mounted to said roller machine in adjustable manner, such that the position of said adjustable mounting bracket relative to said roller machine may be altered.

6. The roller machine of claim 1, further comprising means to adjust the position of said first roller shaft and said first roller relative to said second roller shaft and said second roller comprising bearing assemblies to receive said first roller shaft, cross brace members having threaded apertures to receive threaded rods connected to said bearing assemblies, whereby of said threaded rods within said threaded apertures alters the position of said bearing assemblies, and wherein said adjustable mounting plate is connected to said one of said bearing assemblies.

7. A drive assembly for a dual coacting roller machine, said roller machine having a first roller shaft and a first roller and a second roller shaft and second roller mounted in parallel to define a gap between said first roller and said second roller, wherein said gap may be increased or decreased by repositioning said first roller shaft and said first roller relative to said second roller shaft and said second roller, and wherein said first roller shaft and said first roller relative rotate in a direction opposite to said second roller shaft and said second roller, said drive assembly comprising:

a drive sprocket connected to said second roller shaft;

a driven sprocket connected to said first roller shaft;

a pair of idler sprockets;

a belt connecting said drive sprocket, said driven sprocket and said pair of idler sprockets, such that rotation of said drive sprocket results in rotation of said driven sprocket and said pair of idler sprockets; and a mounting bracket connecting said driven sprocket to one of said pair of idler sprockets in a fixed spatial relationship, such that repositioning of said driven sprocket relative to said drive sprocket results in corresponding repositioning of said one of said pair of idler sprockets.

8. The drive assembly of claim 7, wherein said idler sprockets are disposed adjacent said drive sprocket.

9. The drive assembly of claim 7, wherein said idler sprockets are disposed adjacent said driven sprocket.

10. The drive assembly of claim 7, wherein said pair of idler sprockets consists of a paired idler sprocket and a tensioner idler sprocket, said tensioner idler sprocket being connected to said mounting bracket in an adjustable position, whereby said belt may be tightened by repositioning said tensioner idler sprocket relative to said mounting bracket.

11. The drive assembly of claim 7, wherein said pair of idler sprockets consists of a paired idler sprocket and a tensioner idler sprocket, said paired idler sprocket being connected to said mounting bracket in a fixed position.

12. The drive assembly of claim 7, further comprising means to adjust the position of said driven sprocket and said mounting bracket relative to said drive sprocket comprising bearing assemblies to receive said first roller shaft, cross brace members having threaded apertures to receive threaded rods connected to said bearing assemblies, whereby rotation of said threaded rods within said threaded apertures alters the position of said bearing assemblies, and wherein said adjustable mounting plate is connected to said one of said bearing assemblies.

13. A dual coacting roller machine, said roller machine having a first roller shaft and a first roller and a second roller shaft and second roller mounted in parallel to define a gap between said first roller and said second roller, wherein said gap may be increased or decreased by repositioning said first roller shaft and said first roller relative to said second roller shaft and said second roller, and wherein said first roller shaft and said first roller relative rotate in a direction opposite to said second roller shaft and said second roller, and further comprising a drive assembly comprising:

a drive sprocket connected to said second roller shaft;

a driven sprocket connected to said first roller shaft;

a pair of idler sprockets;

a belt connecting said drive sprocket, said driven sprocket and said pair of idler sprockets, such that rotation of said drive sprocket results in rotation of said driven sprocket and said pair of idler sprockets;

power means to rotate said drive sprocket; and a mounting bracket connecting said driven sprocket to one of said pair of idler sprockets in a fixed spatial relationship, such that repositioning of said driven sprocket relative to said drive sprocket results in corresponding repositioning of said one of said pair of idler sprockets.

14. The drive assembly of claim 13, wherein said idler sprockets are disposed adjacent said drive sprocket.

15. The drive assembly of claim 13, wherein said idler sprockets are disposed adjacent said driven sprocket.

16. The drive assembly of claim 13, wherein said pair of idler sprockets consists of a paired idler sprocket and a tensioner idler sprocket, said tensioner idler sprocket being connected to said mounting bracket in an adjustable position, whereby said belt may be tightened by repositioning said tensioner idler sprocket relative to said mounting bracket.

17. The drive assembly of claim 13, wherein said pair of idler sprockets consists of a paired idler sprocket and a tensioner idler sprocket, said paired idler sprocket being connected to said mounting bracket in a fixed position.

18. The drive assembly of claim 13, further comprising means to adjust the position of said driven sprocket and said mounting bracket relative to said drive sprocket comprising bearing assemblies to receive said first roller shaft, cross brace members having threaded apertures to receive threaded rods connected to said bearing assemblies, whereby rotation of said threaded rods within said threaded apertures alters the position of said bearing assemblies, and wherein said adjustable mounting plate is connected to said one of said bearing assemblies.

* * * * *